US010641029B2

(12) United States Patent
Ashmead

(10) Patent No.: US 10,641,029 B2
(45) Date of Patent: May 5, 2020

(54) DOOR CONTROL SYSTEM AND METHODS OF OPERATING THE SAME

(71) Applicant: S Wiley Consulting, LLC, Flourtown, PA (US)

(72) Inventor: James Ashmead, Middleton, DE (US)

(73) Assignee: S WILEY CONSULTING, LLC., Flourtown, PA (US)

( * ) Notice: Subject to any disclaimer, the term of this patent is extended or adjusted under 35 U.S.C. 154(b) by 108 days.

(21) Appl. No.: 15/635,638

(22) Filed: Jun. 28, 2017

(65) Prior Publication Data

US 2018/0002970 A1 Jan. 4, 2018

Related U.S. Application Data

(60) Provisional application No. 62/356,302, filed on Jun. 29, 2016.

(51) Int. Cl.

| | |
|---|---|
| ***E05F 11/00*** | (2006.01) |
| ***E05F 15/63*** | (2015.01) |
| *E05F 15/79* | (2015.01) |

(52) U.S. Cl.

CPC ..... *E05F 15/63* (2015.01); *E05F 15/79* (2015.01); *E05Y 2900/132* (2013.01)

(58) Field of Classification Search

CPC ..... E05F 15/63; E05F 15/79; E05Y 2900/132
USPC ..... 49/324
See application file for complete search history.

(56) References Cited

U.S. PATENT DOCUMENTS

| | | | | | |
|---|---|---|---|---|---|
| 815,914 | A | * | 3/1906 | Evans | E05F 15/63 49/345 |
| 2,294,041 | A | | 10/1940 | Mims | |
| 2,651,074 | A | * | 9/1953 | Slopa | E05F 1/1016 16/80 |
| 2,946,081 | A | * | 7/1960 | Juergens | E05F 1/1016 16/80 |
| 3,422,575 | A | | 1/1969 | Armstrong | |
| 4,101,162 | A | * | 7/1978 | Koehn | B60J 7/041 296/100.1 |
| 4,365,442 | A | * | 12/1982 | Speer | E05F 15/53 49/30 |
| 4,503,723 | A | * | 3/1985 | Reid | E05F 15/63 49/339 |
| 4,979,261 | A | * | 12/1990 | Lasier | E05F 3/04 16/62 |
| 5,094,499 | A | * | 3/1992 | Simone, Jr. | B60J 7/1621 296/100.1 |
| 5,180,199 | A | | 1/1993 | Teichmann et al. | |
| 5,375,374 | A | | 12/1994 | Rohroff, Sr. | |
| 5,392,562 | A | * | 2/1995 | Carambula | E05F 3/22 248/300 |
| 5,634,296 | A | | 6/1997 | Hebda | |

(Continued)

FOREIGN PATENT DOCUMENTS

| | | |
|---|---|---|
| DE | 102013007191 | 5/2014 |
| DE | 102013109293 | 8/2014 |

(Continued)

*Primary Examiner* — Basil S Katcheves
(74) *Attorney, Agent, or Firm* — Vedder Price P.C.

(57) ABSTRACT

A door access system including a housing, a motor in the housing with the motor coupled to a shaft extending from the bottom of the housing, an arm rotatively connected to the shaft, a roller rotatively connected to the arm with the roller engaging the surface of a door.

18 Claims, 5 Drawing Sheets

(56) References Cited

U.S. PATENT DOCUMENTS 5,725,260 A 3/1998 Eikmeier et al.
5,878,530 A * 3/1999 Eccleston ..... E05F 15/63 49/139
6,032,762 A 3/2000 O'Donnell
6,061,964 A * 5/2000 Arnell ..... E05F 15/63 49/358
6,309,005 B1 * 10/2001 Priest ..... B60J 7/1621 296/100.06
6,347,485 B1 * 2/2002 Hebda ..... E05B 17/0029 292/341.16
6,623,062 B1 * 9/2003 Hoffman ..... B60J 7/1621 296/100.03
6,675,535 B2 1/2004 Armstrong et al.
6,848,525 B1 2/2005 Peterson
7,296,380 B2 11/2007 Backman
7,373,756 B2 5/2008 Okulov et al.
7,707,773 B2 5/2010 Thielmann et al.
7,971,316 B2 * 7/2011 Copeland, II ..... E05F 3/12 16/79
8,074,401 B2 * 12/2011 Brown ..... E05F 15/53 49/339
8,390,219 B2 * 3/2013 Houser ..... E05F 15/63 318/255
8,407,937 B2 * 4/2013 Houser ..... E05F 15/63 49/139
8,720,113 B1 * 5/2014 Krivoy ..... E05F 15/63 49/339
8,839,940 B2 * 9/2014 Guan ..... G07D 11/14 194/351
9,500,017 B2 * 11/2016 Sugiura ..... E05F 1/1016
2005/0091928 A1 * 5/2005 Okulov ..... E05F 15/41 49/341
2006/0090400 A1 5/2006 Los et al.
2009/0265992 A1 * 10/2009 Hass ..... E05F 15/63 49/340
2016/0060923 A1 3/2016 Ford
2016/0060941 A1 3/2016 Ingham et al.

FOREIGN PATENT DOCUMENTS

EP 0298514 6/1991
EP 1201857 10/2000
EP 1748129 7/2005
WO WO1996012079 4/1996
WO WO2010052012 5/2010

* cited by examiner

DOOR CONTROL SYSTEM AND METHODS OF OPERATING THE SAME

The present disclosure is a Non-Provisional patent application claiming the benefit of and priority to U.S. Provisional Patent Application No. 62/356,302 filed on Jun. 29, 2016, which is incorporated by reference herein in its entirety.

BACKGROUND OF THE INVENTION

As the need to protect valuable information and possessions has increased, the size and weight of doors used to protect sensitive information has also increased. With this increase in door weight, the ability of many uses to open and close a high security door has become an challenge. Specifically, increased door weight has made entering and exiting facilities more difficult for disabled individuals as many of these doors are not compliant with the Americans with Disabilities Act. Further, due to a door's weight, the ability to determine whether a door is successfully closed after an entrance is also difficult requiring the need for visual inspection of a door to determine its closed state.

Therefore, the need exists for a door access system that will automate the process of opening and closing heavy security doors.

BRIEF SUMMARY OF THE INVENTION

One embodiment of the present disclosure includes a door access system including a housing, a motor in the housing with the motor coupled to a shaft extending from the bottom of the housing, an arm rotatively connected to the shaft, a roller rotatively connected to the arm with the roller engaging the surface of a door.

Another embodiment includes a second arm rotatively coupled to the shaft.

Another embodiment includes a second roller connected to the second arm with the second roller engaging a surface of the door.

In another embodiment, the first arm is positioned closer to the housing on the shaft than the second arm.

In another embodiment, the second arm is longer than the first arm.

In another embodiment, the motor rotates the shaft.

In another embodiment, the second roller remains in contact with the surface of the door during the entire travel of the door.

In another embodiment, the roller engages the surface of the door during a portion of the door's travel.

In another embodiment, the housing is positioned above a door.

In another embodiment, the door is a SKIFF door.

Another embodiment of the present disclosure includes the method of operating a door, including the steps of rotating an arm about a shaft by a motor connected to the shaft, where the arm includes a roller attached to one end with the roller being in contact with a surface of the door.

Another embodiment includes the step of rotating a second arm that is coupled to the shaft.

In another embodiment, the second arm includes a second roller connected to the second arm with the second roller engaging a surface of the door.

In another embodiment, the first arm is positioned closer to the housing on the shaft than the second arm.

In another embodiment, the second arm is longer than the first arm.

In another embodiment, the motor rotates the shaft.

In another embodiment, the second roller remains in contact with the surface of the door during the entire travel of the door.

In another embodiment, the roller engages the surface of the door during a portion of the door's travel.

In another embodiment, the housing is positioned above a door.

In another embodiment, the housing is made from metal.

DETAILED DESCRIPTION OF THE INVENTION

Figure 1:
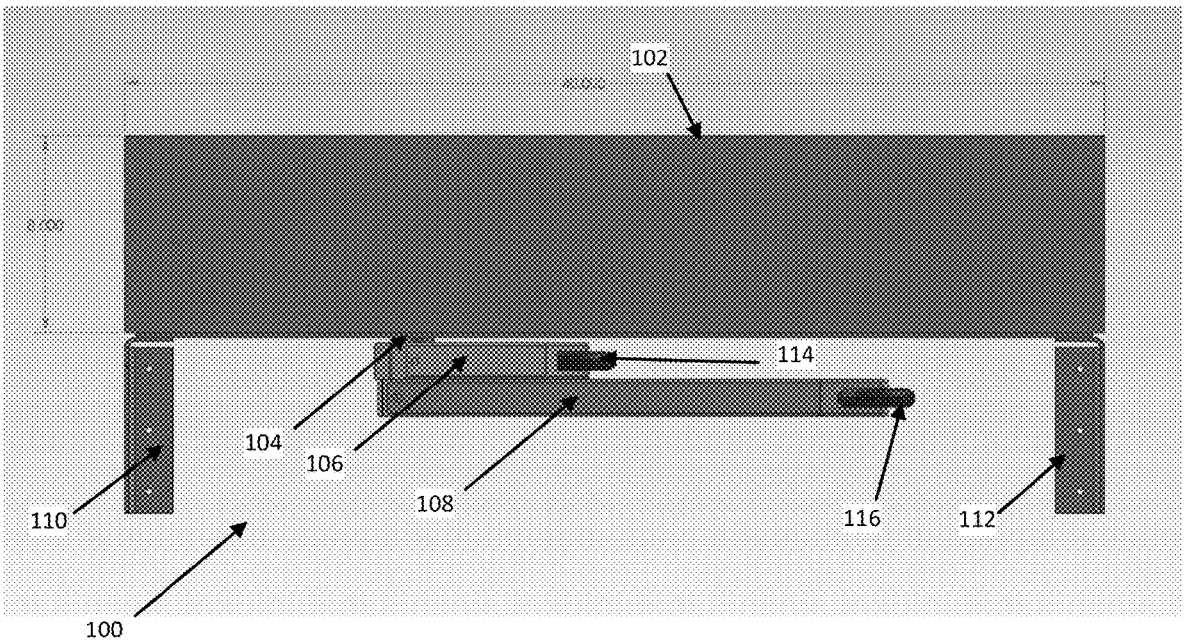
FIG. 1 depicts a front view of a door control system.

FIG. 1 depicts a front view of a door control system 100. The door control system 100 includes a upper portion 102 having a shaft 104 extending from a lower side of the upper portion 102. The shaft 104 rotatively engages a first arm 106 and a second arm 108 such that the shaft 104 rotates the arms 106 and 108 around the shaft 104 when a rotational force is applied to the shaft 104. In one embodiment, the first arm 106 is shorter than the second arm 108. In another embodiment, the second arm 108 is shorter than the first arm 106. The upper portion 102 includes a cavity (not shown) that is sized to accommodate components required to drive the arms 106 and 108. Mounting brackets 110 and 112 are secured to the bottom surface of the upper portion 102 for mounting of the door control system 100 above a door.

Each arm 106 and 108 includes a roller 114 and 116 that is rotatively coupled to the end of each arm 106 and 108. The rollers 114 and 116 are configured to engage the surface of a door, and to rotate along the surface of the door as the arms 106 and 108 are rotated. The rollers 114 and 116 may be made of any material including rubber or plastic.

Figure 2:
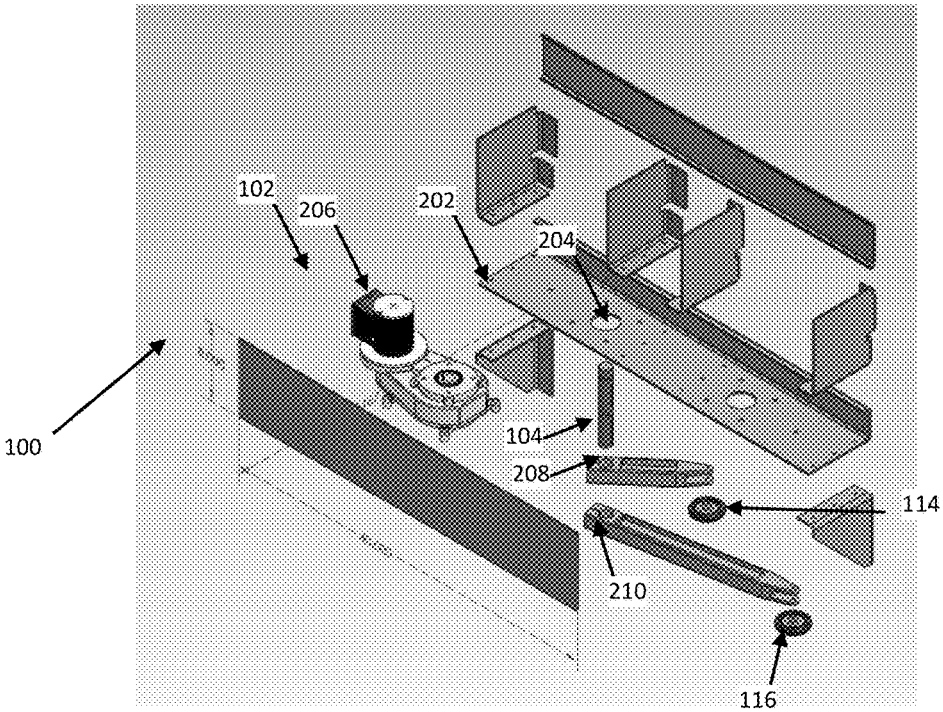
FIG. 2 depicts a breakaway view of the door control system of FIG. 1.

FIG. 2 depicts a breakaway view of the door control system 100. The upper portion 102 includes a lower panel 202 that includes an opening 204 that is sized to accommodate the shaft 104. A motor 206 is positioned on the lower panel 204 such that an opening (not shown) in the motor 206 is positioned over the opening 204. When assembled, one end of the shaft 104 passes through the opening 204 and is engaged by the opening (not shown) in the motor 206 such that the motor 206 rotates the shaft 104. An end of the shaft 104 opposite the end engaged by the motor 206, passes through openings 208 and 210 in the first arm 106 and second arm 108.

To open a door, the motor 206 rotates the shaft 104 causing the first arm 106 and second arm 108 to rotate together to engage the door. As the first arm 106 is shorter than the second arm 108, the first arm 106 exerts a higher torque on the door initially pushing the door open. As the door opens, the first arm 106 disengages the door allowing the second arm 108 to push the door open the remainder of the way. The second arm 108 is configured to continue to move the door open after the first arm 106 disengages the door.

Figure 3:
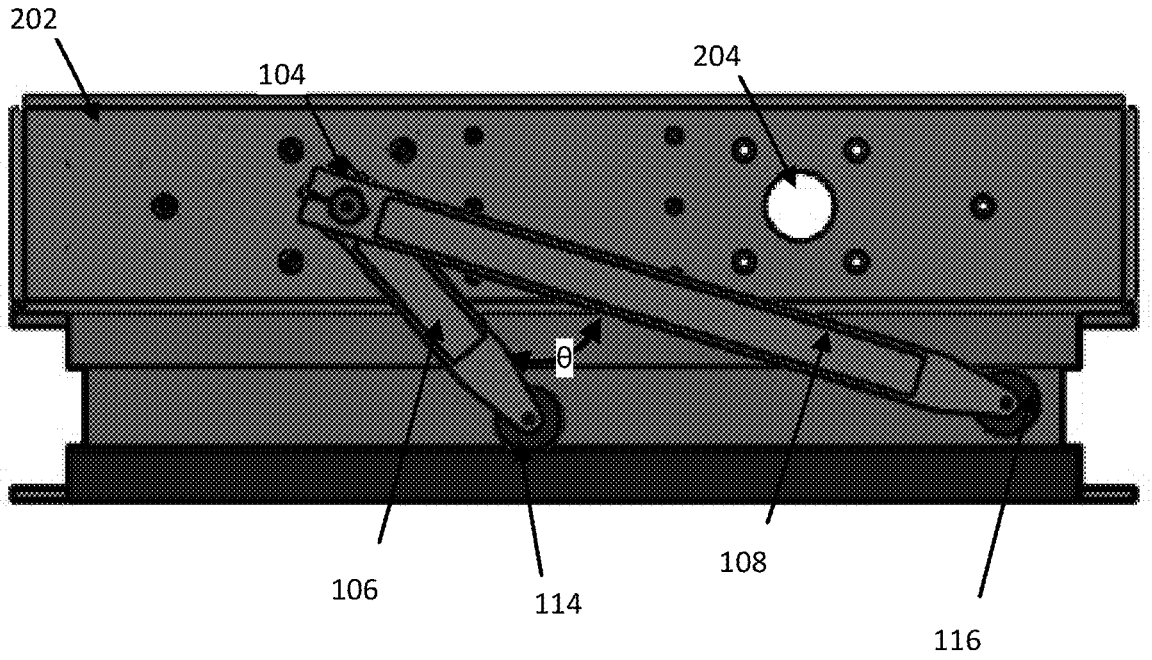
FIG. 3 depicts a bottom view of the door control system of FIG. 1.

FIG. 3 depicts a bottom view of the door control system 100. The arms 106 and 108 are connected by shaft 104 with the arms 106 and 108 being separated by an angle θ. The angle θ is adjusted such that the rollers 114 and 116 on each arm are in contact with the door when the door is closed. As the motor 206 actuates, the arms 106 and 108 push the door from a closed position to an open position along the rollers 114 and 116 which are in contact with the surface of the door. The first arm 106, being the shorter arm, remains in contact with the door during a portion of the travel before disengaging with the door, and the second arm 108, being the longer arm, remains in contact with the door during the length of the travel of the door.

Figure 4:
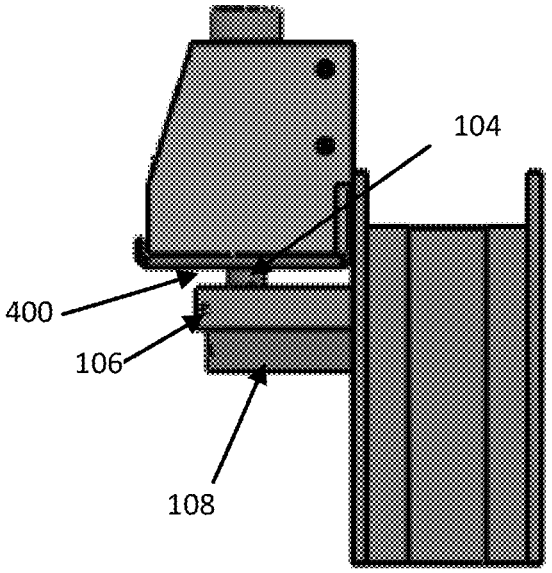
FIG. 4 depicts a side view of the door control system of FIG. 1.

FIG. 4 depicts a side view of the door control system 100. The first arm 106 is positioned on the shaft 104 closest to the motor 206 with the second arm 108 being positioned below the first arm on the shaft 104. The first arm 106 is separated from the lower panel 202 by a gap 400. The size of the gap 400 is adjusted such that the rollers 114 and 116 of the first arm 106 and second arm 108 engage the surface of the door.

Figure 5:
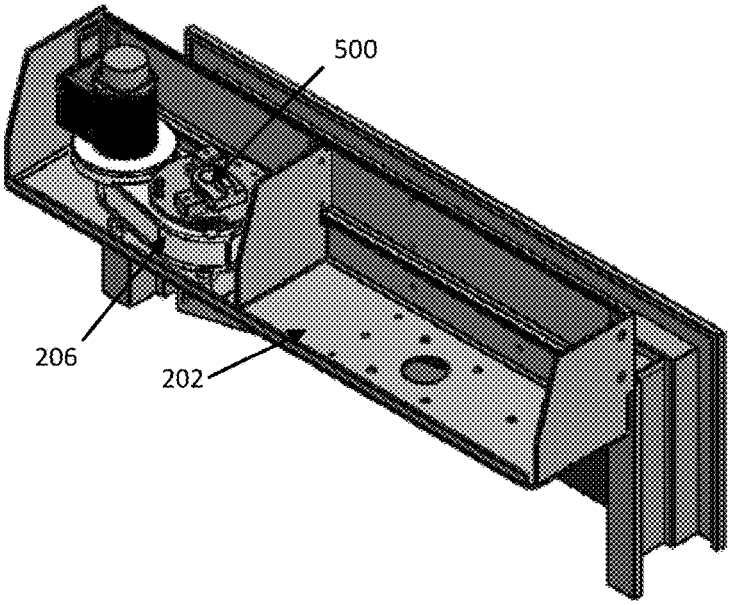
FIG. 5 depicts a perspective view of the door control system of FIG. 1.

FIG. 5 depicts a perspective view of the door control system 100. The motor 206 is mounted on one end of the panel 202 with the shaft 104 extending through a drive shaft 500 of the motor 106.

Figure 6:
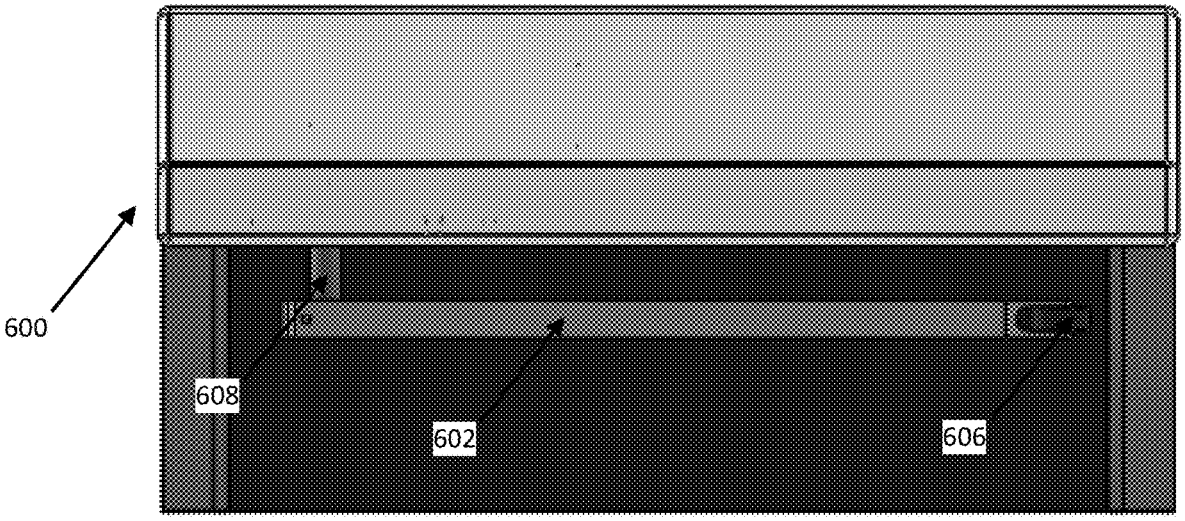
FIG. 6 depicts a door control system.
Figure 7:
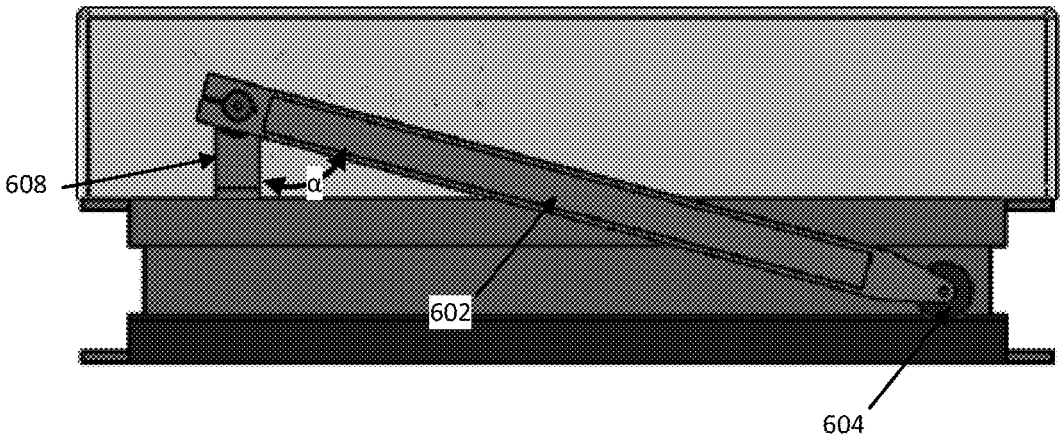
FIG. 7 depicts a bottom view of the door control system of FIG. 6.

FIG. 6 depicts another embodiment of a door control system 600. The door control system 600 includes a single arm 602 and roller 604. The single arm 602 extends across a substantial portion of the door such that the single arm 106 can move the door open and closed. A motor 206 drives the arm via shaft 606. FIG. 7 depicts a bottom view of the door control system 600. The single arm 602 is offset from the shaft 608 by an angle α. The angle α is adjusted such that the surface of the roller 604 engages a position near the end of the door when the door is in the closed position and engages a position near the hinged portion of the door when the door is open.

Figure 8:
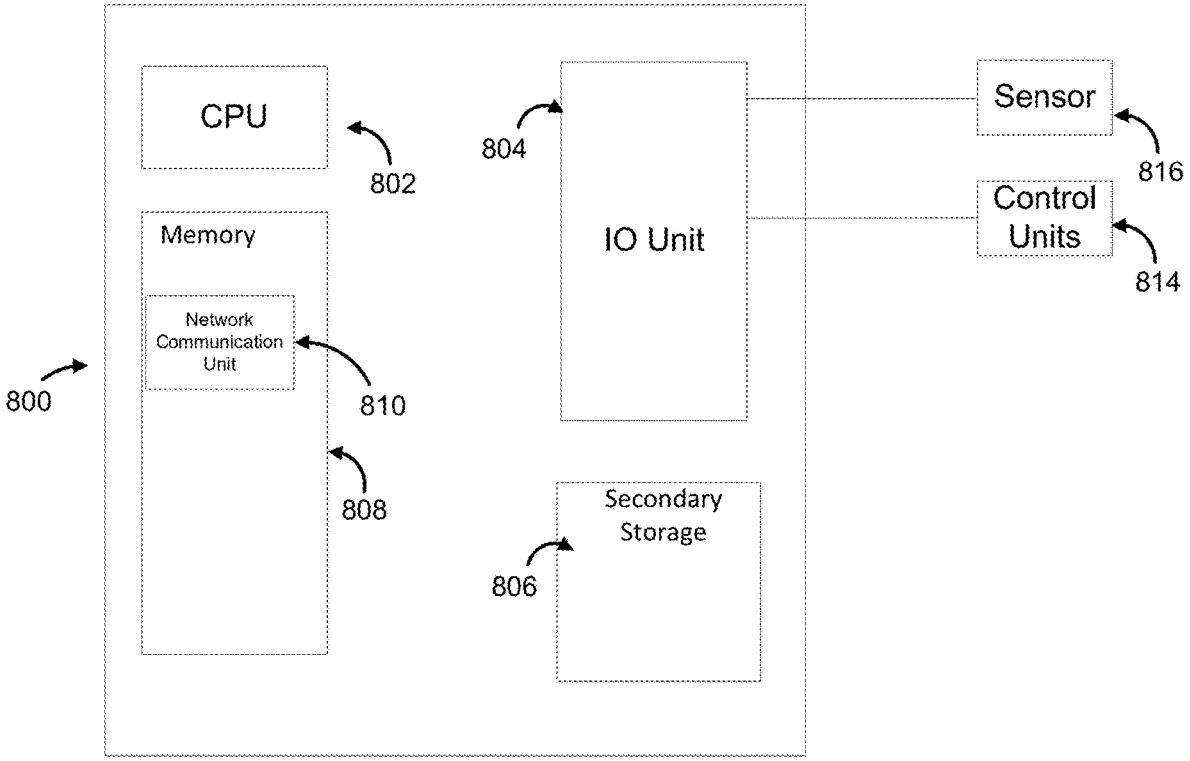
FIG. 8 depicts a schematic representation of a control unit used to control a door control system.

FIG. 8 depicts a schematic representation of a control unit 800 used to control a door control system. The control unit 800 includes a CPU 802, an JO unit 804, a secondary storage unit 806, and a memory 808 that includes a network communication unit 810. The IO unit 804 is communicatively coupled to a plurality of sensors 812 and control units 814. Each sensor 812 is configured to sense environmental information and transmit the sensed information back to the IO unit 804. Each control unit 814 is electronically or mechanically coupled to a device such that the control unit 800 converts a signal transmitted from the IO unit 804 into a signal capable of effecting the operation of the device coupled to the control unit 814. The sensors 812 and control units 814 may be coupled to the IO unit 804 via a wired or wireless connection.

The network communication unit 810 is configured to connect to a communications network. The control unit 800 may communicate with other control units 800 over the network communication unit 810, using any communication protocol including BACnet, Modbus, LONworks, Fieldbus, CANbus, Profibus, TCP/IP, Ethernet, or any other communication protocol. The control unit 800 also operate as a stand-alone unit that does not communicate over a network.

Figure 9:
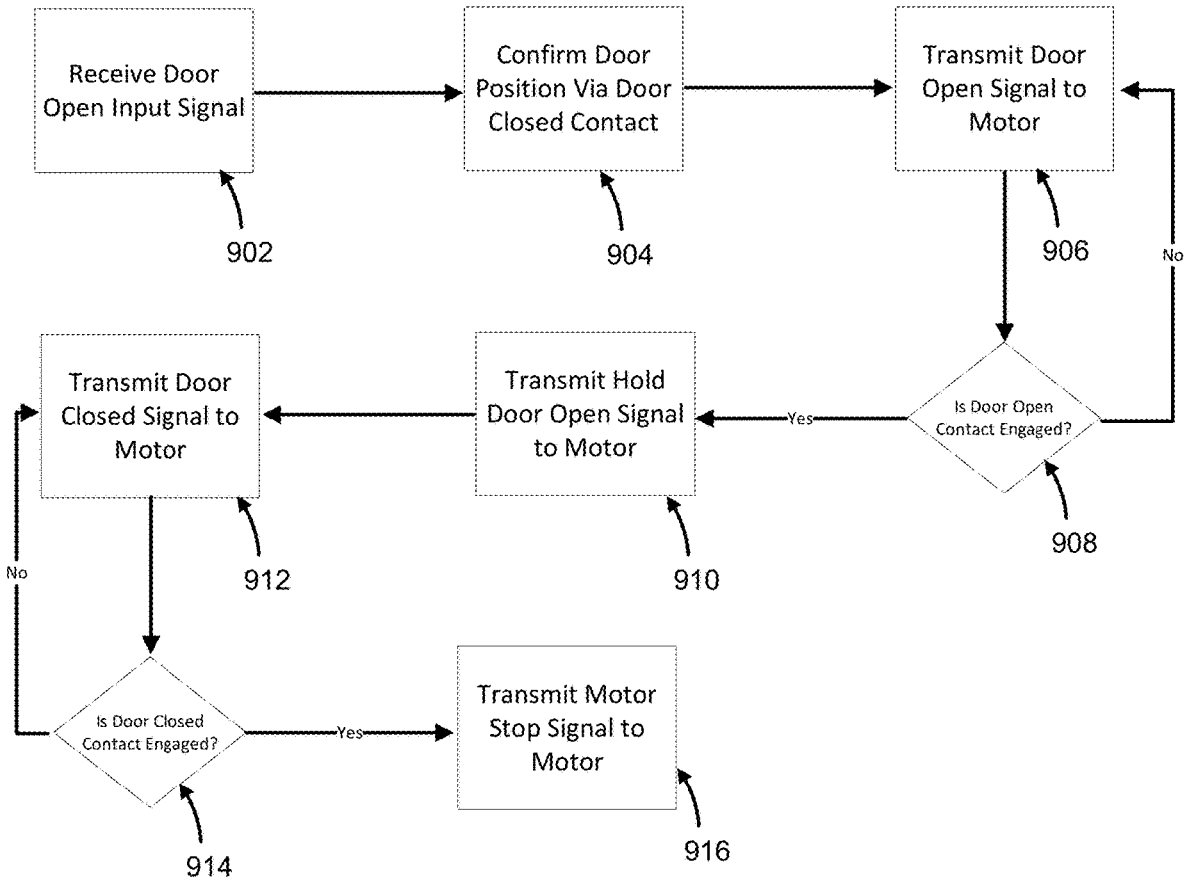
FIG. 9 depicts a schematic representation of the operation of a door control system.

FIG. 9 depicts a schematic representation of the operation of a door control system. In step 902, the control unit 800 receives an door input signal from a sensor 816. The sensor 816 may be any type of indicator including a push button, RF or RFID card, or an open command from an remote mounted access control unit (not shown). In step 904, the control unit 800 confirms the position of the door via a door open contact sensor and a door closed contact sensor. After the door is confirmed to be closed, the control unit 800 transmits a door open signal to the motor 206 via a control unit 816. The control unit 816 may be a relay or a contact on the motor 206. In step 908, the control unit 800 continues to transmit the door open signal to the motor until the door open contact sensor engages, confirming the door is in the full open position. In another embodiment, the control unit 800 may transmit the motor open signal for a predetermined amount of time.

In step 910, the control unit 800 transmits a hold door open signal to the motor 206. In one embodiment, the hold door open signal is a signal to initiate a brake in the motor 206 to prevent the door from closing. In another embodiment, the hold door open signal is a signal for the motor 206 to stop. In step 912, after a predetermined amount of time has elapsed, the control unit 800 transmits a door closed signal to the motor 206. In step 914, the control unit 800 monitors to the door close contact sensor to determine when the door is closed. The control unit 800 provides the door closed signal to the motor 206 until the door closed contact sensor confirms the door is closed. In step 916, when the door is confirmed closed by the door closed contact sensor, the control unit 800 transmits a stop signal to the motor 206.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

The invention claimed is:

1. A door access system including:

a housing capable of being mounted to a portion of a door that is angularly rotatable between a fully closed position and a fully open position;

a motor at least partially enclosed within the housing and connected to a shaft extending from a bottom of the housing;

the motor including a brake located in proximity to the shaft, such that initiation of the brake prevents the rotation of the shaft;

the shaft rotativley engaged with a first arm and a second arm, such that rotation of the shaft causes the first arm and the second arm to rotate about the shaft;

the first arm having a first roller contacting a surface of the door and the second arm having a second roller contacting the surface of the door;

the first arm being positioned closer to the motor on the shaft than the second arm and the second arm having a length that is greater than the first arm, such that rotation of the shaft causes the first roller and the second roller to roll along the surface of the door in a parallel manner when the door is moved between the fully closed position and a first angular position that that is located between the fully closed position and the fully open position;

wherein further rotation of the shaft causes only the second roller to roll along the surface of the door when the door is moved between the first angular position and the fully open position; and wherein the first arm is separated from the bottom of the housing by a first gap and wherein the second arm is separated from the first arm by a second gap.

2. The door access system of claim 1 wherein the motor rotates the shaft.

3. The door access system of claim 1 wherein the second roller remains in contact with the surface of the door during the entire travel of the door.

4. The door access system of claim 1 wherein the housing is positioned above the door.

5. The door access system of claim 1, wherein the first arm and the second arm are repositionable about the shaft so that the first arm and the second arm are in contact with the surface of the door in the fully closed position.

6. The door access system of claim 1, wherein the first gap has a first width that can be adjusted to ensure that the first roller engages with the surface of the door when the door is in the fully closed position.

7. The door access system of claim 1, wherein the second gap has a second width that can be adjusted to ensure that the second roller engages with the surface of the door when the door is in the fully closed position.

8. The door access system of claim 1, wherein the rotation of the shaft causes the first arm to exert a greater amount of torque on the surface of the door than the second arm when the door is between the fully closed position that the first angular position.

9. The door access system of claim 1, wherein the first roller is composed of at least one of a rubber or plastic material.

10. The door access system of claim 1, wherein the second roller is composed of at least one of a rubber or plastic material.

11. A door access system including:

a housing capable of being mounted to a portion of a door that is angularly rotatable between a fully closed position and a fully open position;

a motor at least partially enclosed within the housing and connected to a shaft extending from a bottom of the housing;

the motor including a brake located in proximity to the shaft, such that initiation of the brake prevents the rotation of the shaft;

the shaft rotativley engaged with a first arm and a second arm, such that rotation of the shaft causes the first arm and the second arm to rotate about the shaft;

the first arm having a first roller contacting a surface of the door and the second arm having a second roller contacting the surface of the door;

the first arm being positioned closer to the motor on the shaft than the second arm and the second arm having a length that is greater than the first arm, such that rotation of the shaft causes the first roller and the second roller to roll along the surface of the door in a parallel manner when the door is moved between the fully closed position and a first angular position that that is located between the fully closed position and the fully open position; and wherein further rotation of the shaft causes only the second roller to roll along the surface of the door when the door is moved between the first angular position and the fully open position.

12. The door access system of claim 11, wherein the first arm and the second arm are repositionable about the shaft so that the first arm and the second arm are in contact with the surface of the door in the fully closed position.

13. The door access system of claim 11, wherein the rotation of the shaft causes the first arm to exert a greater amount of torque on the surface of the door than the second arm when the door is between the fully closed position that the first angular position.

14. The door access system of claim 11, wherein the first roller is composed of at least one of a rubber or plastic material.

15. The door access system of claim 11, wherein the second roller is composed of at least one of a rubber or plastic material.

16. The door access system of claim 11, wherein the motor rotates the shaft.

17. The door access system of claim 11, wherein the second roller remains in contact with the surface of the door during the entire travel of the door.

18. The door access system of claim 11, wherein the housing is positioned above the door.

* * * * *